US005401112A

United States Patent [19]

Dornbusch et al.

[11] Patent Number: 5,401,112

[45] Date of Patent: Mar. 28, 1995

[54] FILL/INVERT PACKAGE WITH SPECIALIZED SEALING, NON-FLOW-THROUGH ELEVATOR SYSTEM

[75] Inventors: Arthur H. Dornbusch; Paul J. Green, both of Cincinnati; Marc Greenwald, Loveland, all of Ohio; Alex S. Szekely, Edison, N.J.

[73] Assignee: The Procter & Gamble Company, Cincinnati, Ohio

[21] Appl. No.: 151,313

[22] Filed: Nov. 12, 1993

Related U.S. Application Data

[63] Continuation of Ser. No. 760,661, Sep. 16, 1991, abandoned.

[51] Int. Cl.[6] ..... A45D 40/06; A45D 40/08

[52] U.S. Cl. ..... 401/68; 401/75; 401/175

[58] Field of Search ..... 401/68, 75, 175

[56] References Cited

U.S. PATENT DOCUMENTS

| | | | |
|---|---|---|---|
| 2,079,744 | 5/1937 | Maguire | 221/79 |
| 2,818,167 | 12/1957 | McKinley | 206/56 |
| 2,876,161 | 3/1959 | Gleschi | 424/73 |
| 2,980,246 | 4/1961 | Leshin | 206/56 |
| 3,454,181 | 7/1969 | Riss et al. | 220/39 |
| 3,612,705 | 10/1971 | Duval | 401/75 |
| 3,907,441 | 9/1975 | Idec et al. | 401/75 |
| 3,917,417 | 11/1975 | Lang | 401/72 |
| 4,369,158 | 1/1983 | Woodruff et al. | 264/268 |
| 4,521,127 | 6/1985 | Tomburo et al. | 401/68 |
| 4,545,696 | 10/1985 | Carluccio | 401/175 |
| 4,552,161 | 11/1985 | Hill et al. | 132/88.5 |
| 4,580,920 | 4/1986 | Schmidt | 401/175 |
| 4,605,330 | 8/1986 | Crowley et al. | 401/75 X |
| 4,621,935 | 11/1986 | Sussman | 401/82 |
| 4,664,547 | 5/1987 | Rosenwinkel | 401/175 |
| 4,700,448 | 10/1987 | Parker | 29/434 |
| 4,702,399 | 10/1987 | Davis | 222/390 |
| 4,781,483 | 11/1988 | Lorscheidt | 401/55 |
| 4,792,065 | 12/1988 | Soehnlein et al. | 222/387 |
| 4,812,066 | 3/1989 | Gueret | 401/78 |
| 4,950,094 | 8/1990 | Yorks | 401/75 |
| 4,984,718 | 1/1991 | Cardia | 401/68 X |
| 5,000,600 | 3/1991 | Cardia et al. | 401/75 |

FOREIGN PATENT DOCUMENTS

| | | |
|---|---|---|
| 798715 | 11/1968 | Canada . |
| 0135861 | 4/1985 | European Pat. Off. . |
| 196385A | 10/1986 | European Pat. Off. . |
| 332593 | 9/1989 | European Pat. Off. . |
| 1548336 | 12/1968 | France . |
| 915547 | 7/1954 | Germany . |
| 2807472 | 8/1979 | Germany . |
| 3118893 | 11/1982 | Germany . |
| 3139192 | 4/1983 | Germany . |
| 322053 | 11/1929 | United Kingdom . |
| 8606257A | 11/1986 | WIPO . |

*Primary Examiner*—Steven A. Bratlie

*Attorney, Agent, or Firm*—Dean L. Garner; William Scott Andes; Ronald W. Kock

[57] ABSTRACT

A swivel up package for a deodorant or antiperspirant having specialized sealing which prevents leakage of product, in either its molten or volatile state, during manufacture, shipment and storage by containing all of the product within or above the elevator. The preferred package has a body of an oval or circular cross-section with an open top and a closed bottom. The bottom has a centralized aperture adapted to receive a spindle having a screw shaft disposed within the body and a dial or handwheel disposed outside the body. Also disposed within the body of the package is the elevator having a threaded central hub that is in engagement with the screw shaft. The periphery of the elevator is sealed along the internal surface of the body of the package. Further sealing is provided between the hub/threaded shaft interface when the elevator is in its lowermost position. The elevator has a reservoir to receive molten product during the fill process. The seals are such that flow of air and molten product to the reservoirs is possible only through the top of the package. The volumetric capacity is at least as great as the volume intermediate the fill line of the package, filled in its upright condition with the product in a molten or liquid form, and the inner surface of a forming means used to shape the top of the product. There is also provided a fill/invert process for manufacturing a cosmetic stick-type product using the package described above.

3 Claims, 6 Drawing Sheets

FILL/INVERT PACKAGE WITH SPECIALIZED SEALING, NON-FLOW-THROUGH ELEVATOR SYSTEM

This is a continuation of application Ser. No. 07/760,661, filed on Sep. 6, 1991, now abandoned.

FIELD OF THE INVENTION

This invention relates to packages for cosmetic products in stick form and a process for producing such products. More particularly, the invention relates to such packages having an elevator/screw dispensing means which is especially adapted for use with the fill/invert process of manufacture.

BACKGROUND OF THE INVENTION

In the design and manufacture of a deodorant or antiperspirant stick product, it is preferable that the top of the stick have a convex contour and that its cross-sectional shape be circular or oval. The convex shape is desired so that the product is comfortable to apply upon its first application and has a good appearance to the consumer. The oval cross-section makes application more efficient by requiring a minimum number of strokes to apply the product evenly. Furthermore, with such products it is preferred by consumers to have a package that dispenses the product using an elevator/-screw system, commonly referred to as a swivel-up package. Such a package is typically equipped with an elevator platform, disposed within the package at its bottom end, having a spindle in threaded engagement therewith. A dial to turn the spindle is located outside the bottom of the package for use by the consumer. As the consumer uses the product, the dial is turned to move the elevator towards the top of the package, pushing up the product stick. By turning the dial in the opposite direction the product stick can be retracted.

One method of manufacturing such products is known as the bottom-fill method. The desired shape is generally achieved by providing a package having an oval or circular cross-section and a cap, of the same cross-section, on the top of the package. The cap has a smooth concave inner surface which is adapted to function as a mold in forming the top of the stick. The product, in its molten state, is poured into the package from the bottom. While the product is still in a molten or liquid form, the elevator/screw system is attached to the bottom of the container and the bottom is sealed. The product and container are then allowed to cool, whereby the product takes on the desired shape. An example of this bottom fill method can be found in U.S. Pat. No. 4,369,158 issued to Woodruff et al. on Jan. 18, 1983.

Another method used to manufacture shaped stick-type products is known as the fill/invert method. This method achieves a product with the desired shape by providing a package having an oval or circular cross-section, but with a closed bottom already having the elevator/screw system attached. The product is poured into the package from the top and the top of the package is sealed by a cap having a smooth concave inner surface for molding the end of the stick. The package is then inverted so that some of the molten product flows from the bottom of the package to the top to fill the outage volume intermediate the original fill line and the cap. The package is kept in this position during cooling.

Because the cosmetic products are often composed of a large proportion of volatile materials, such as alcohol, it is necessary to seal the package thoroughly, prior to use by consumers, in order to prevent the escape of these materials during manufacture, shipment and storage. When the package is not effectively sealed, volatiles evaporate and the product shrinks, losing its shape, fragrance and aesthetic appearance. A major problem of sealing these packages has been to provide an effective sealing means on the bottom of the package, where the elevator/screw system is attached. The screw shaft of these packages extends through a hole in the bottom of the where it is attached to a dial. Product in either its molten or volatile state has access to this hole where it can escape.

One way to avoid this problem is to use a push-up dispensing system rather than the elevator/screw design. With such a system there is no hole in the bottom because no elevator shaft or dial means is needed to dispense the product. However, as mentioned earlier, consumers prefer the elevator/screw design to other dispensing systems.

Another way to prevent volatiles from escaping, but using an elevator/screw design, is described in U.S. Pat, No. 4,950,094 issued to Yorks on Aug. 21, 1990. This device uses a resilient washer placed between the dial and the bottom wall of the package. The design is effective in sealing the hole in the bottom of the package where the screw shaft extends through. However, when using the bottom-fill method this hole is not the only place on the bottom of the package that needs to be sealed. In bottom fill packages the bottom wall is not integral with the package but must be attached after filling. The base must be sealed to the side walls to prevent the escape of volatiles therefrom. While the washer of the Yorks patent seals the interface of the screw shaft and the base of the package it does nothing to prevent the escape of volatiles from the junction of the base of the package and its sidewalls.

Therefore, the fill/invert system is preferred over the bottom-fill method, since the base of the package is integral with the sidewalls and does not need to be sealed. When fill/invert packages are filled, molten product is poured from the top of the package where it flows past the elevator through apertures in the elevator platform, and down to the bottom of the package. Leakage of molten product occurs through the hole on the bottom of the package where the screw shaft extends. Furthermore, as with the bottom fill packages, even after the product is solidified, volatile materials evaporate and escape through this hole. The washer of the Yorks patent does an effective job of sealing the hole on the bottom of fill/invert packages.

However, the washer design of the Yorks patent has many drawbacks. The assembly step involved complicates the manufacturing process and requires secondary assembly. Furthermore, the resilient washer is expensive and adds to the cost of the final product.

It is therefore an object of the present invention to provide a cosmetic package that effectively seals against leakage of molten product and volatiles, but which is easy to manufacture and inexpensive.

It is another object of the present invention to provide a cosmetic package with an elevator/screw dispensing system, and which seals against loss of product, whether in a molten or volatile state, by containing all of the product within or above the elevator thereby preventing it from reaching the bottom wall and the hole therein.

It is yet another object of the present invention to provide a process for making a cosmetic stick in the container set forth above using a fill/invert method.

SUMMARY OF THE INVENTION

In accordance with one aspect of the present invention there is provided a swivel up package that can be used with a fill/invert manufacturing method. The package comprises a body having an internal surface for containing and shaping the product, open top end and a closed bottom end with a central aperture therein. A spindle is axially oriented within the package and is rotatably mounted at the bottom end of the package through the aperture. The package further includes an elevator with a threaded central hub that is engagement with the spindle. The periphery of the elevator is sealed along the internal surface of the body. Further sealing is provided between the hub/threaded shaft interface. These seals ensure that all of the product, whether in a liquid or volatile state, is contained within or above the elevator. The elevator of the package has a reservoir to contain molten product during the fill process. Flow of molten product is possible only through the top of the package. The volumetric capacity of the reservoir is at least as great as the volume intermediate the fill line of the package, filled in its upright position with the product in molten form, and the inner surface of the forming means used to shape the top of the product.

In accordance with another aspect of the present invention there is provided a process for manufacture of a solid stick-form product of high volatility. The process comprises the steps of providing a swivel-up package similar to the one described above and pouring molten product into the top of the package, thereby filling the reservoirs with a predetermined amount of product and filling the body of the package to a fill level near the top end. Leakage of molten product around and through the elevator is blocked so that no molten product lies intermediate the elevator and the bottom of the package. A sealing means is applied to the top of the package that is adapted to prevent leakage of molten product from the top end and to provide an internal molding surface for shaping the end of the product. The package is inverted such that the product in the reservoir flows out to fill the volume intermediate the fill level and the sealing means. The product is then cooled such that it solidifies in the inverted position.

BRIEF DESCRIPTION OF THE DRAWINGS

While the specification concludes with claims particularly pointing out and distinctly claiming the subject invention, it is believed that the same will be better understood from the following description taken in conjunction with the following drawings in which:

Fig, 6 is a side view of the top half of the elevator,

Fig, 7 is a side view of the bottom half of the elevator,

DETAILED DESCRIPTION OF THE INVENTION

Figure 1:
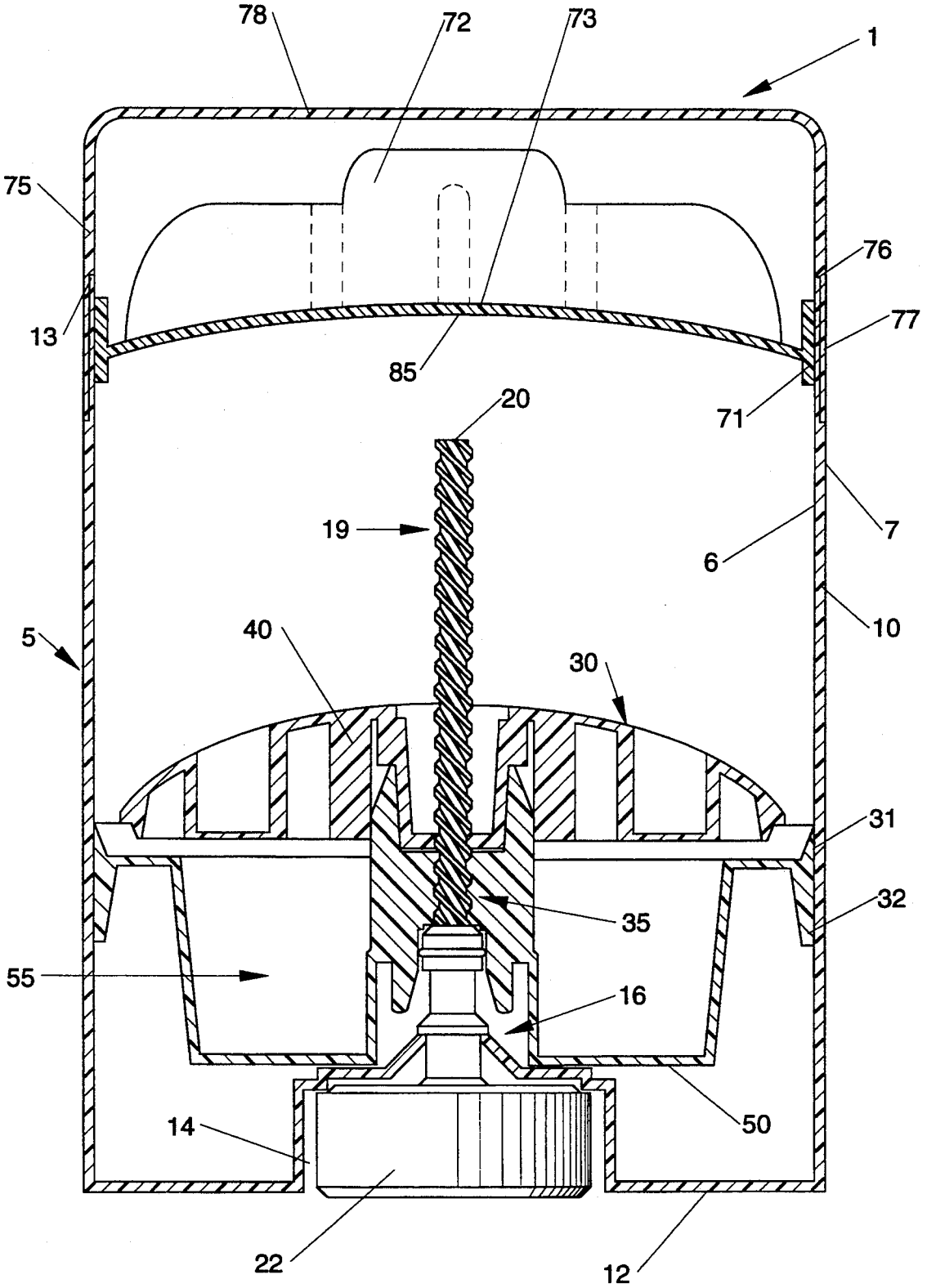
FIG. 1 is a sectional elevational view showing the package of the present invention.

Referring now to the drawings in detail, wherein like numerals indicate the same element throughout the views, there is shown in FIG. 1 a package 1 for dispensing a cosmetic product in stick form, such as a deodorant or antiperspirant. Package 1 comprises body member 5 having elongated tubular side walls 10. In one embodiment the sidewalls will have an oval or circular cross section. Bottom wall 12 of body 5 has an internally stepped recess 14 of a generally circular cross-section having a central aperture 16 provided therein. The top end 13 of body member 5 is open. Body 5 is preferably made of a rigid plastic such as polypropylene.

Disposed within body member 5 is a spindle 19 having threaded shaft member 20 and handwheel 22. Shaft member 20 extends through aperture 16 and is disposed within body 5 whereas dial or handwheel 22 is external of the body and is disposed within stepped recess 14 of bottom wall 12. As can best be seen from FIG. 3, spindle 19 is provided with annular flange 25 that is in snap fit engagement with tapered tabs 15 of stepped bore 14. This secures engagement of spindle 19 within body member 5. Spindle 19 is typically made of polypropylene.

Referring back to FIG. 1, disposed within body member 5 is elevator 30 having a top wall 40 and bottom wall 50 and reservoir 55. Elevator 30 has threaded central hub 35 which is engaged with threaded shaft 20 of spindle 19. The periphery of the elevator is sealed against the contiguous sections of the internal surface 6 of body 5 by an upper seal 31 and a lower seal 32, spaced from one another and extending along the elevators outer perimeter. These seals prevent product from escaping around the elevator to the bottom of the package during manufacture, shipment and storage. Flow of air and product to and from the reservoirs is possible only through the top of the package. In a preferred embodiment, as can best be seen from FIG. 7, the upper seal comprises a tapered annular flange extending across the entire circumference of the elevator, referred to herein as a fin seal. The lower seal comprises an annular ring extending across the entire circumference of the elevator, referred to herein as a bead seal. Furthermore, the elevator 30 is preferably made of a flexible material such as polyethylene in order to provide a better seal.

Figure 2:
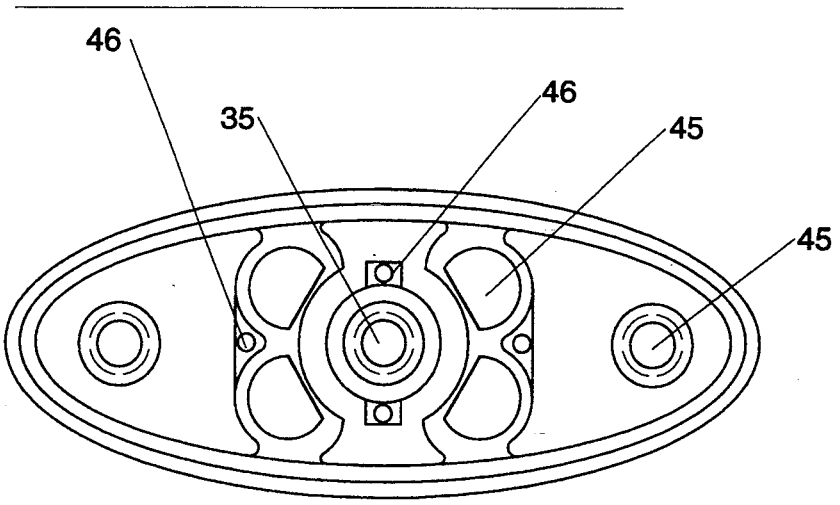
FIG. 2 is a top view of the top wall of the elevator.

As seen in FIG. 1 top wall 40 has a convex configuration to provide comfort to the user when the elevator is at its fully extended position at the end of the product use cycle. By referring to FIG. 2 one can see that top wall 40 has a plurality of apertures 45. These apertures allow liquid or molten product to flow into and out of reservoir 55 during the fill/invert process. The apertures have sidewalls that extend into the elevator which are substantially filled with product, following solidification, to secure the product to elevator 30. Air can become trapped between the sidewalls of the various apertures and the top wall of the elevator, during the fill process. The volume occupied by air, and not by product, will cause the package to be filled with the incorrect amount of product. To allow the air to escape during the fill process, top wall 40 preferably includes vents 46.

Top wall 40 can also be used as a visual run-out indicator by the consumer. If the product is sufficiently transparent upon solidification and top wall 40 exhibits a sufficiently dark color, consumers will see the top Wall through the product and will know they are almost out when top wall 40 extends beyond the top 13 of body 5 towards the end of the product use cycle.

Figure 6:
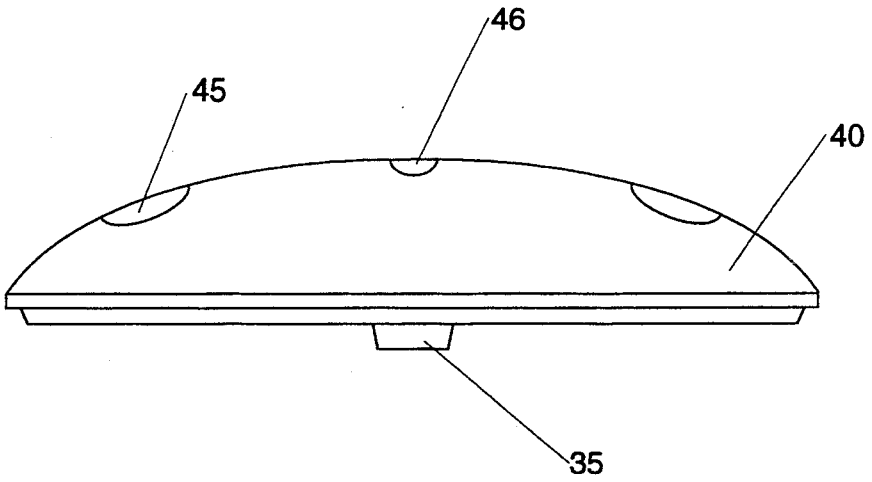
Figure 7:
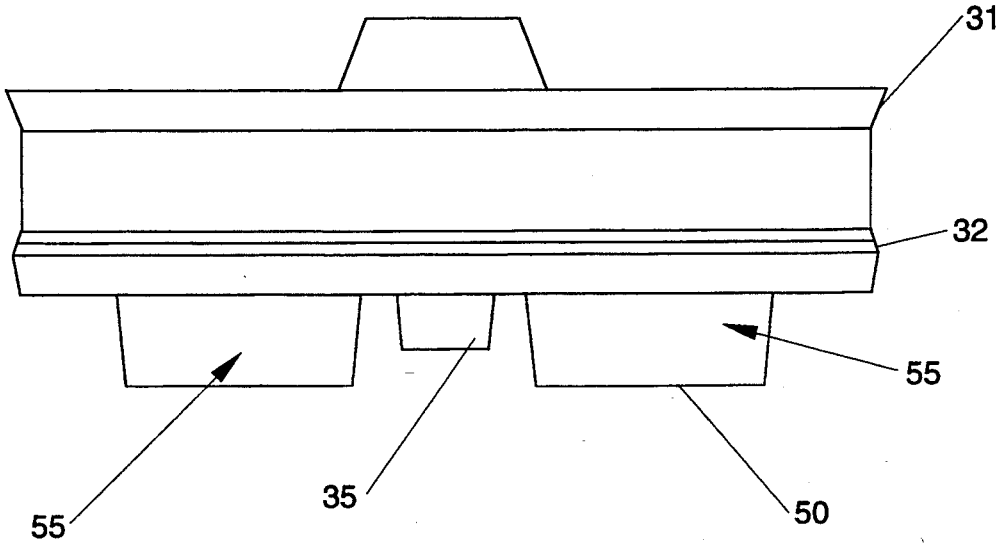

Due to the practical limitations in molding the elevator, its design usually requires that it be comprised of two separate sections, as shown in FIGS. 6 and 7. FIG. 6 is a side view of the top section of the elevator 30 which includes top wall 40. FIG. 7 is a side view of the bottom section of elevator 30, which includes reservoir 55 and seals 31 and 32. The top and bottom sections are joined to one another before insertion into the package. This prevents the top section from falling out when it extends beyond the top of the package near the end of the product use cycle.

Figure 3:
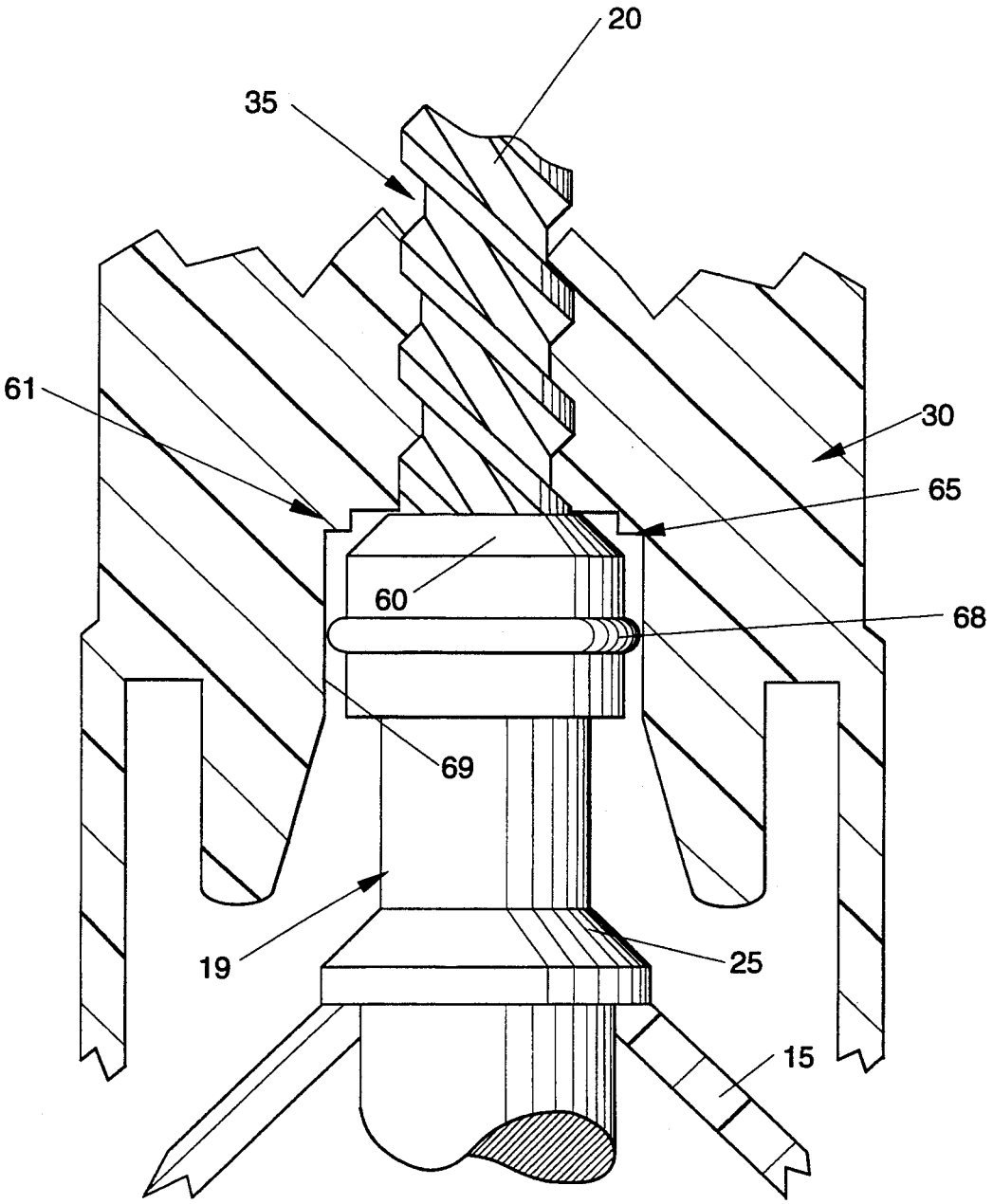
FIG. 3 is a greatly enlarged sectional view of the hub/threaded shaft interface of the package.

By referring to FIG. 3 one can best see how the interface between threaded central hub 35 of elevator 30 and threaded shaft 20 of spindle 19 are sealed when the elevator is in its lowermost position, as shown in FIG. 1. Spindle 19 is provided with a tapered annular ring 60 directly below the bottom of threaded shaft 20. Threaded central hub 35 of elevator 30 has an axial stepped bore 65. When the elevator 30 is in its lowermost position, the edge of stepped bore 65 compresses against tapered ring 60 along its circumference forming line seal 61 that seals the hub/threaded shaft interface. It has been found that a good seal is obtained when ring 60 is tapered at an angle of about 45°. As mentioned earlier, it is preferred that elevator 30 be made of a flexible material such as polyethylene. This will increase the effectiveness of line seal 61 by compensating for molding tolerances.

Spindle 19 further includes annular rib 68 which exerts a compressive force against wall 69 of central hub 35. Annular rib 68 can act both as a secondary seal for the hub/threaded shaft interface and as a brake to prevent elevator 30 from creeping up during handling, manufacturing, shipping and for storage operations. Movement of the elevator 30 prior to use by the consumer is undesirable since it will jeopardize the effectiveness of the point seal 61. Rib 68 can be intermittent if it is to serve only as a brake or continuous to serve both as a brake and as a seal.

Referring back now to FIG. 1, top end 13 of body 5 is sealed by inner cap 70 whose top wall 73 has inner surface 85 which is concave. As seen in FIG. 4A inner surface, 85 extends beyond the fill line L of the product when the product is filled in its upright position. The volume "V" intermediate the fill line "L" and inner surface 85 of inner cap 70 is herein defined as the outage volume. The volumetric capacity of the reservoir 55 must be at least as great as the outage volume.

Figure 5:
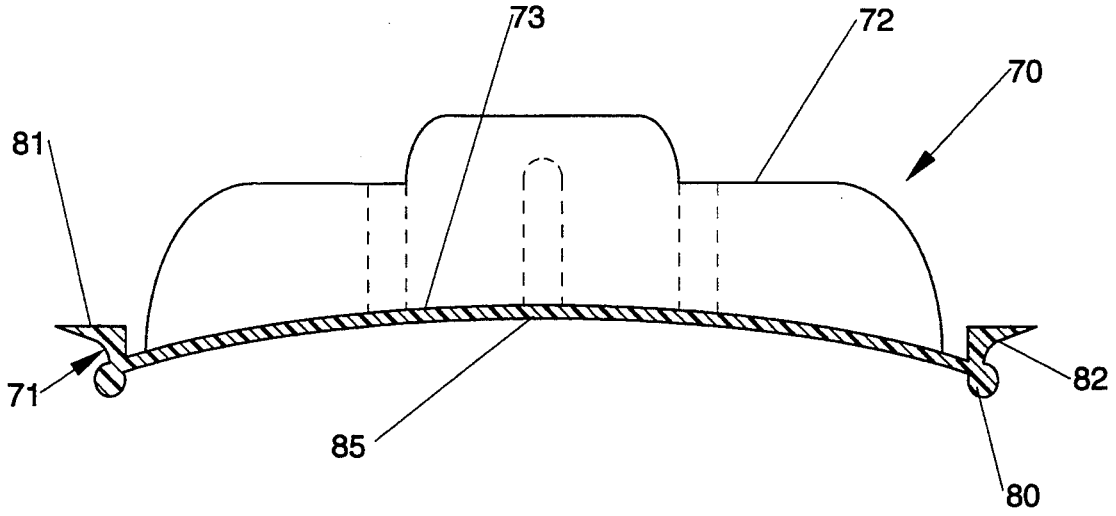
FIG. 5 is a sectional elevational view of the inner cap of the package.

Inner cap 70 has its side walls 71 disposed within body 5. As can be seen from FIG. 5 inner cap 70 has an annular ring 80 at the bottom of side wall 71 that extends along the inner cap's entire circumference. The annular ring exerts a compressive force against inner surface 6 of body 5 forming a bead seal that seals the top 13 of package 1 from the escape of volatiles. To provide a secondary seal inner cap 70 is provided with a tapered annular ring 82 that also extends along the entire circumference of the inner cap forming a fin seal with the inner surface of the tubular sidewalls. Annular flange 81 of inner cap 70 extends across the top edge of tubular sidewall 10, as can be seen from FIG. 1, to prevent further downward movement of the inner cap. Inner cap 70 is preferably made from a flexible material such as polyethylene to create a more effective seal. Inner cap 70 is further provided with handle 72. Upon first using the product the consumer will grasp handle 72 and pull off inner cap 70 and throw it away. Inner cap 70 may also be removed by rotating handwheel 22 until the product pushes the cap off.

To seal the package after the first use and to further seal top end 13, package I is further provided with outer cap 75. Outer cap 75 has its side walls 77 entirely disposed outside of body 5 so that they exert a compressive force against outer surface 7 of body 5 to create a seal. Outer cap 75 has a flange 76 on the inner surface of side wall 77. Flange 76 engages with the top edge of the body 5 to prevent further downward movement of outer cap 75. This is to provide sufficient space between top end 13 of body 5 and top 78 of outer cap 75. This space is needed to accommodate the product after the first use so that the product does not need to be retracted after every application.

Figure 4B:
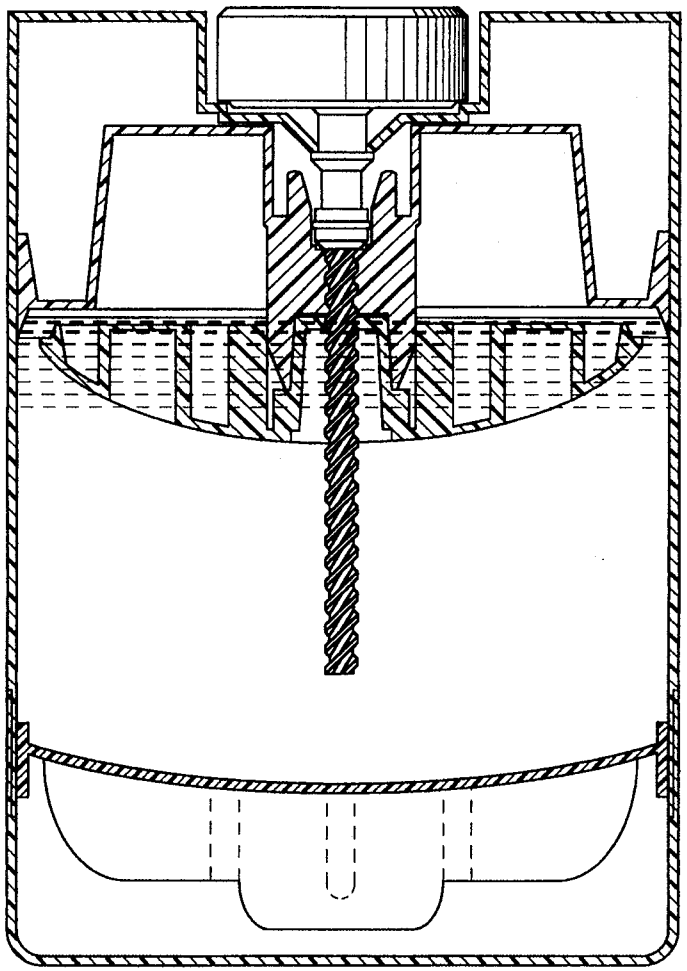
FIG. 4B is a sectional elevational view of the package after it is inverted, subsequent to filling.
Figure 4A:
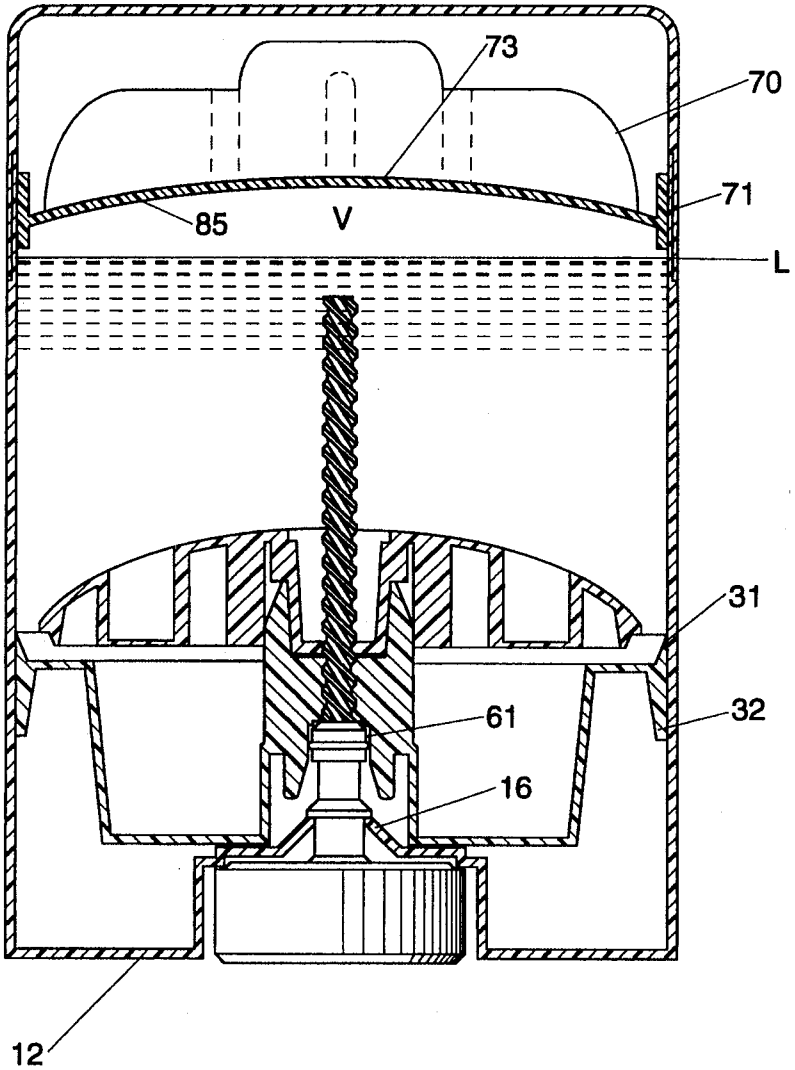
FIG. 4A is a sectional elevational view of the package after the filling process.

The method of manufacture of a cosmetic product in stick form, using the package of the present invention can best be described by referring to FIGS. 1, 4A and 4B. The method begins by having the package of FIG. 1 with the elevator in its lowermost position but with the inner and outer caps, 70 and 75, removed. Molten product is poured into the top end 13 of body 5 thereby filling the reservoir 55 with a predetermined quantity of molten product and filling the body of the package to the fill line "L". The upper and lower seals, 31 and 32 respectively, and point seal 61 keep all of the molten product within or above the elevator. This substantially prevents molten product from reaching the bottom end 12 of the package where it can escape through aperture 16.

After pouring of the molten product a sealing means is applied to the top end 13 of body 5 to prevent leakage of molten product therethrough. The inner surface of the sealing means is preferably concave and smooth in order to give the desired shape to the final stick form product. In a preferred embodiment the sealing means used is inner cap 70, as shown in FIG. 4A. In another embodiment the sealing means could be a puck having a concave inner surface which is removed after solidification, whereupon the package is capped.

Upon placement of the sealing means the package is inverted, as shown in FIG. 4B. Product in the reservoir flows through the top wall 40 of the elevator to fill the outage volume intermediate the fill line and the inner surface of the sealing means, previously occupied by air. The air from this volume flows through the package and through the openings and vents in the top wall 40 to the reservoir 55. Without sufficient means to allow the air to escape to the reservoir, air will be trapped inside the molten product. This creates unsightly and undesirable voids in the product upon solidification.

The product and package are then cooled in the inverted position so that the product stick takes on the desired shape.

Once the product is ready for use by the consumer the outer cap 75 and inner cap 70 are removed, whereby the inner cap 70 is thrown away. Handwheel 22 is then rotated in the direction to advance the elevator 30 and the product stick towards the top end 13 of the package until enough product is exposed to give good application.

While particular embodiments of the present invention have been illustrated and described, it will be obvious to those skilled in the art that various changes and modifications can be made without departing from the spirit and scope of the present invention, and it is intended to cover in the appended claims all such modifications that are within the scope of this invention.

What is claimed is:

1. A fill/invert, swivel up package containing a solid stick-form product of high volatility, said package comprising:

a) a body having an internal surface, an open top end, and a closed bottom end, said closed bottom end having a central aperture therein, said body being upright for filling;

b) an inner cap inserted at said open top end of said body after said body is filled with a molten product to a fill line, said inner cap being sealed against said internal surface of said body to prevent the escape of product volatiles, said inner cap having a concave inner surface which forms an outage volume between said fill line and said concave inner surface;

c) a spindle having a threaded shaft axially oriented within said body and rotatably mounted at said closed bottom end through said central aperture;

d) an elevator positioned within said body at said closed bottom end, said elevator including:

i) a periphery sealed against said internal surface of said body to prevent the escape of product volatiles, said periphery having a continuous upper fin seal and a continuous lower bead seal spaced apart from one another;

ii) a threaded central hub engaged with said threaded shaft, said threaded central hub sealed against said spindle of said threaded shaft to prevent the escape of product volatiles when said elevator is in a lowermost position at said closed bottom end of said body;

iii) a convex top wall; and iv) a reservoir positioned beneath said convex top wall and in fluid communication with only said internal surface of said body located above said periphery of said elevator, said reservoir having a volumetric capacity which is at least as great as said outage volume between said fill line and said concave inner surface of said inner cap, so that when said body of said package is inverted to allow said molten product to solidify, said molten product empties from said reservoir and fills said concave inner surface of said inner cap.

2. The fill/invert package of claim 1 wherein said convex top wall has apertures therein which are filled with said molten product, said molten product thereafter solidifying to hold said product to said convex top wall, said convex top wall also having vents to prevent air being trapped in said apertures during filling of said molten product.

3. The fill/invert package of claim 1 wherein said inner cap has both a circumferential bead seal and a circumferential fin seal to seal said open top end of said package from the escape of volatiles.

* * * * *

UNITED STATES PATENT AND TRADEMARK OFFICE

CERTIFICATE OF CORRECTION

PATENT NO. : 5,401,112

DATED : March 28, 1995

INVENTOR(S) : Arthur H. Dornbusch et al.

It is certified that error appears in the above-identified patent and that said Letters Patent is hereby corrected as shown below:

*Column 1, line 5,delete "Sep. 6, 1991," and insert --Sep. 16, 1991,--.*

*Column 2, line13, delete "the where" and insert --the body where --.*

*Column 3, line 17, delete "engagement" and insert --engaged --.*

*Column 4, lines 35-36, delete "elevators" and insert --elevator's --.*

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*